US006601266B1

(12) United States Patent
Faraci et al.

(10) Patent No.: US 6,601,266 B1
(45) Date of Patent: Aug. 5, 2003

(54) CEILING SCRAPER VACUUM ACCESSORY

(76) Inventors: Clifford C. Faraci, 14801 N. 21st St., Phoenix, AZ (US) 85022; Rustom A. Khan, 2101 E. Claire Dr., Phoenix, AZ (US) 85022; Daniel Winterstein, 17201 N. 9th Ave., Phoenix, AZ (US) 85023

( * ) Notice: Subject to any disclaimer, the term of this patent is extended or adjusted under 35 U.S.C. 154(b) by 0 days.

(21) Appl. No.: 09/923,166

(22) Filed: Aug. 6, 2001

(51) Int. Cl.[7] ..... A47L 7/00
(52) U.S. Cl. ..... 15/401; 15/246.2
(58) Field of Search ..... 15/246.2, 401

(56) References Cited

U.S. PATENT DOCUMENTS

| | | | | | |
|---|---|---|---|---|---|
| 2,879,530 | A | | 3/1959 | Ego | |
| 4,438,977 | A | * | 3/1984 | Chapel | 15/321 |
| 4,947,515 | A | | 8/1990 | Ivarsson | |
| 5,047,089 | A | * | 9/1991 | Grant | 15/364 |
| 5,185,967 | A | | 2/1993 | Cutsforth | |
| 5,454,137 | A | | 10/1995 | Reeves | |
| 5,575,035 | A | | 11/1996 | Reis et al. | |
| 5,951,781 | A | * | 9/1999 | Lucas | 15/401 |
| 6,070,292 | A | * | 6/2000 | Langelaan | 15/401 |
| 6,467,124 | B1 | * | 10/2002 | Small | 15/401 |

FOREIGN PATENT DOCUMENTS

| | | | | |
|---|---|---|---|---|
| DE | 58617 | * | 4/1941 | 15/401 |
| GB | 2 067 889 | * | 8/1981 | 15/401 |

* cited by examiner

*Primary Examiner*—Theresa T. Snider
(74) *Attorney, Agent, or Firm*—Frank J. McGue

(57) ABSTRACT

A vacuum device for scraping and cleaning a ceiling is disclosed which is a ceiling scraper and a vacuum accessory. The ceiling scraper has a handle extending rearwardly from a blade with the blade having a scraping edge adapted to scrape materials from a ceiling at the forward edge thereof. The vacuum accessory has a rearward facing vacuum tube which is adapted to engage a vacuum hose from a vacuum device. Further, the vacuum accessory has a covered tray extending forwardly from the vacuum tube with the covered tray having a vacuum slot opposite the vacuum tube. The vacuum slot, the interior of the covered tray and the vacuum tube are all in gaseous communication. Lastly, the vacuum accessory is adapted to releasably hold the ceiling scraper whereby the scraping edge is positioned directly over the vacuum slot.

14 Claims, 4 Drawing Sheets

CEILING SCRAPER VACUUM ACCESSORY

TECHNICAL FIELD

This invention relates in general to vacuum accessories, and, more particularly, to vacuum accessories for use in conjunction with a ceiling scraper.

BACKGROUND OF THE INVENTION

A popular ceiling decor is known as a popcorn ceiling in which a heavily textured paint coating is provided on a ceiling. While such ceilings provide a much sought after appearence, repainting or recoating such ceilings requires removal of the texture to provide a proper surface for the subsequent coating. Presently, such removal entails using drop cloths to cover all flooring and either covering or removing all furniture positioned beneath the ceiling to be re-painted. The worker typically will employ a ceiling scraper which provides a wide scraping blade on a handle. However, the scraped residue is deposited onto the drop cloth. Once the scraping is complete, the removal of the drop cloths followed by a vacuuming is generally required for clean up.

Thus, there is a need for a scraper device which allows a user to scrape and clean simultaneously. The present invention has met this need.

In addition, most workers in this field are comfortable with the use of ceiling scrapers, particularly the angles of attack to be employed and the general "feel" of the tools. Thus, there is a further need for a scraper device which preserves this comfort level.

U.S. Pat. No. 4,947,515 entitled "Nozzle for Removing Paint" which issued on Aug. 14, 1990 to Ivarsson discloses a nozzle for removing paint chips via a vacuum attachment with a scraper and a source of liquid.

U.S. Pat. No. 2,879,530 entitled "Scraping and Cleaning Device" which issued on Mar. 31, 1959 to Ego shows a scraper combined with a vacuum hose.

None of the known prior art discloses the combination set forth herein.

SUMMARY OF THE INVENTION

It is an object of this invention to provide a vacuum accessory for ceiling scrapers which allows a user to simultaneously scrape and clean a ceiling, particularly, a popcorn ceiling.

It is a further object of this invention to provide a vacuum accessory for ceiling scrapers which allows a user to comfortably use said accessory.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
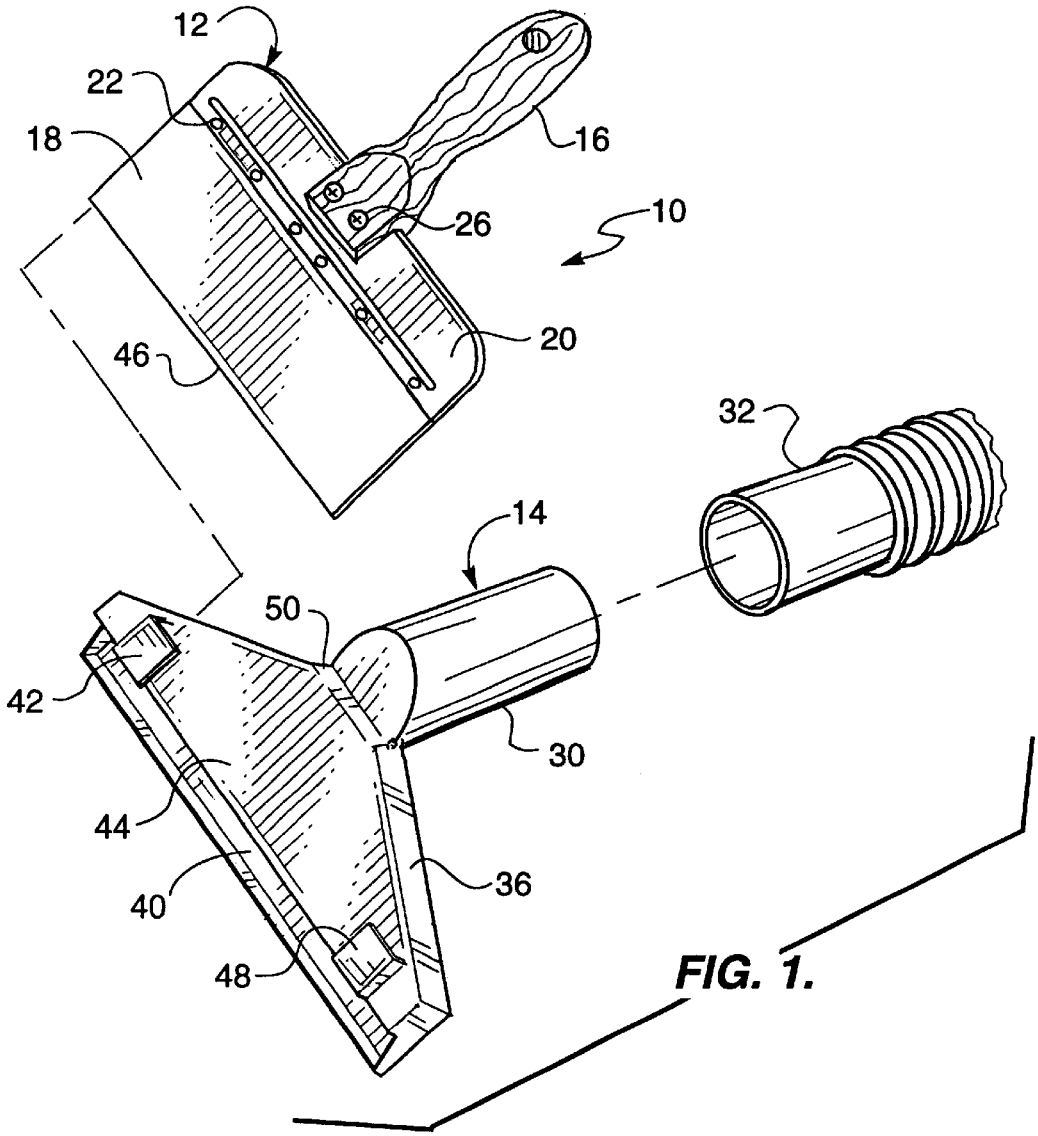
FIG. 1 is a perspective exploded view of one embodiment of the present invention.
Figure 2:
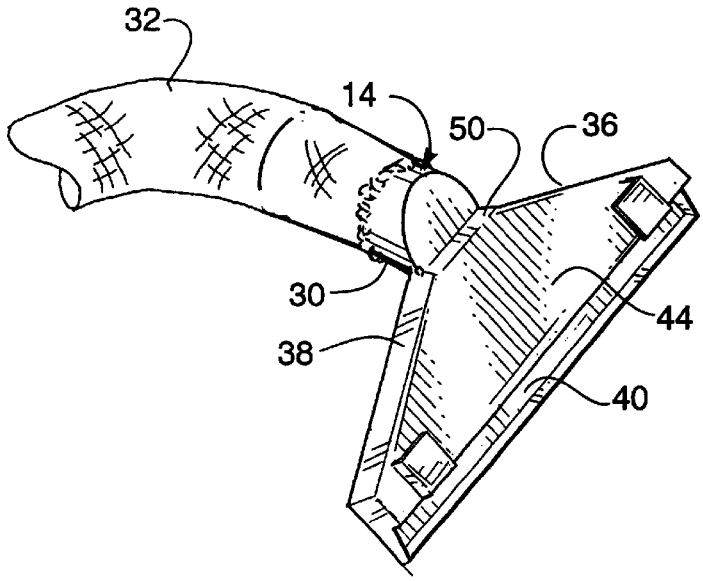
FIG. 2 is a perspective view of a vacuum accessory component of the embodiment of FIG. 1.

The presently preferred embodiment of a device 10 of the present invention is shown in FIGS. 1–5. Device 10 comprises a ceiling scraper 12 and a vacuum accessory 14. Ceiling scraper 12 is well know in the art and are available commercially from such sources as Walboard Tools of Long Beach, Calif. Ceiling scrapers 12 are also known as taping knives in the industry.

Ceiling scraper 12 includes a handle 16 extending rearwardly from a blade 18, preferably about 10 inches wide. The rearward portion of blade 18 is, in the illustrated embodiment, captured between two plates 20 secured by a plurality of rivets 22. Plates 20 are in turn, captured in a slot 24 provided in the forward end of handle 16 and secured therein by one or more handle rivets 26.

Vacuum accessory 14 includes a rearward facing vacuum tube 30 which is adapted to engage a vacuum hose 32 from a vacuum device 34 such as a Shop-Vac® vacuum cleaner. Extending forwardly from vacuum tube 30 is a partially covered tray 36. Enclosed sides 38 of tray 36 extend forwardly and laterally from vacuum tube 30. Opposite vacuum tube 30 is a vacuum slot 40 which is created by extending the a lower panel 42 of tray 36 beyond a cover 44 of tray 36. Vacuum slot 40, the interior of covered tray 36 and vacuum tube 30 are all in gaseous communication whereby a strong suction is provided at vacuum slot 40 when vacuum accessory 14 is connected to vacuum device 34.

To function properly, vacuum accessory 14 is adapted to hold ceiling scraper 12 such that a scraping edge 46 of blade 18 is positioned directly over vacuum slot 40. In the presently preferred embodiment, this adaption is accomplished by providing two L-shaped brackets 48 mounted atop cover 44 which are positioned to engage the edges of blade 18 thereby preventing lateral movement thereof.

Figure 3:
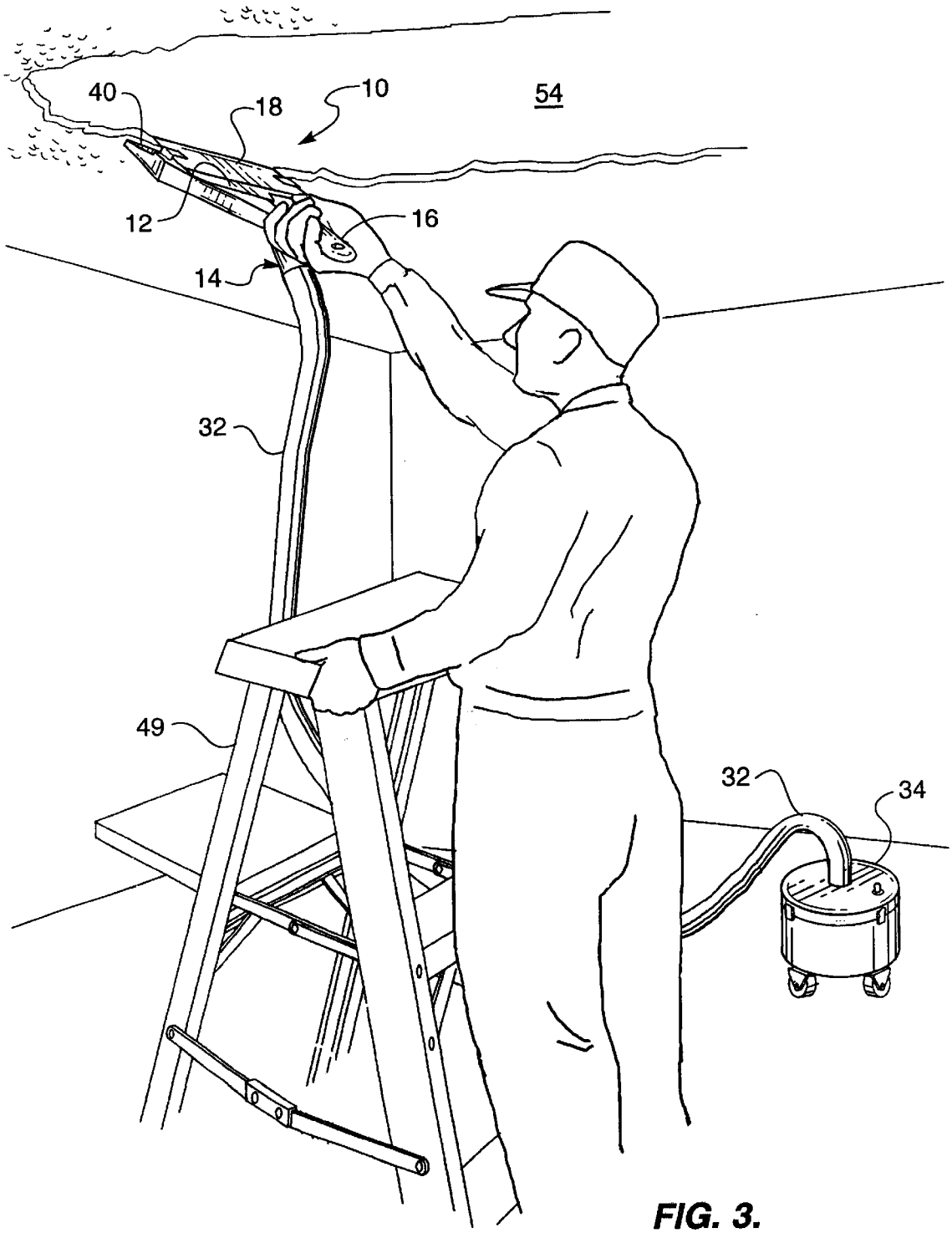
FIG. 3 shows the embodiment of FIG. 1 in use with a vacuum.
Figure 4:
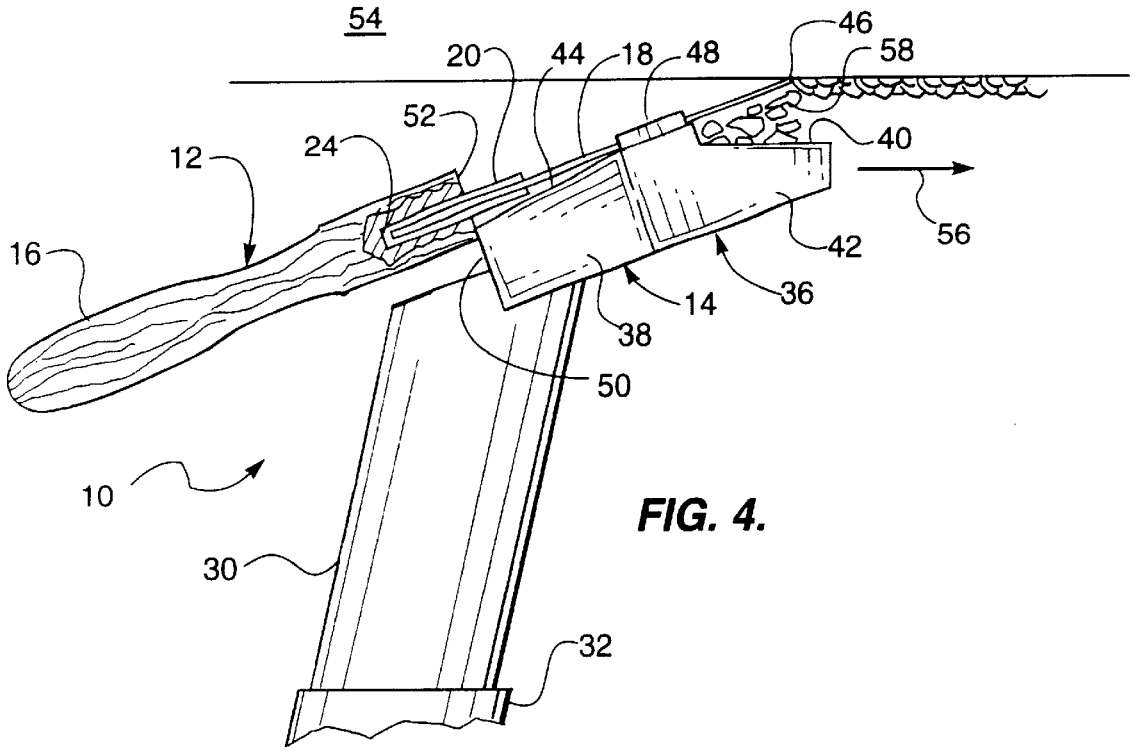
FIG. 4 shows a side view of the embodiment of FIG. 1.
Figure 5:
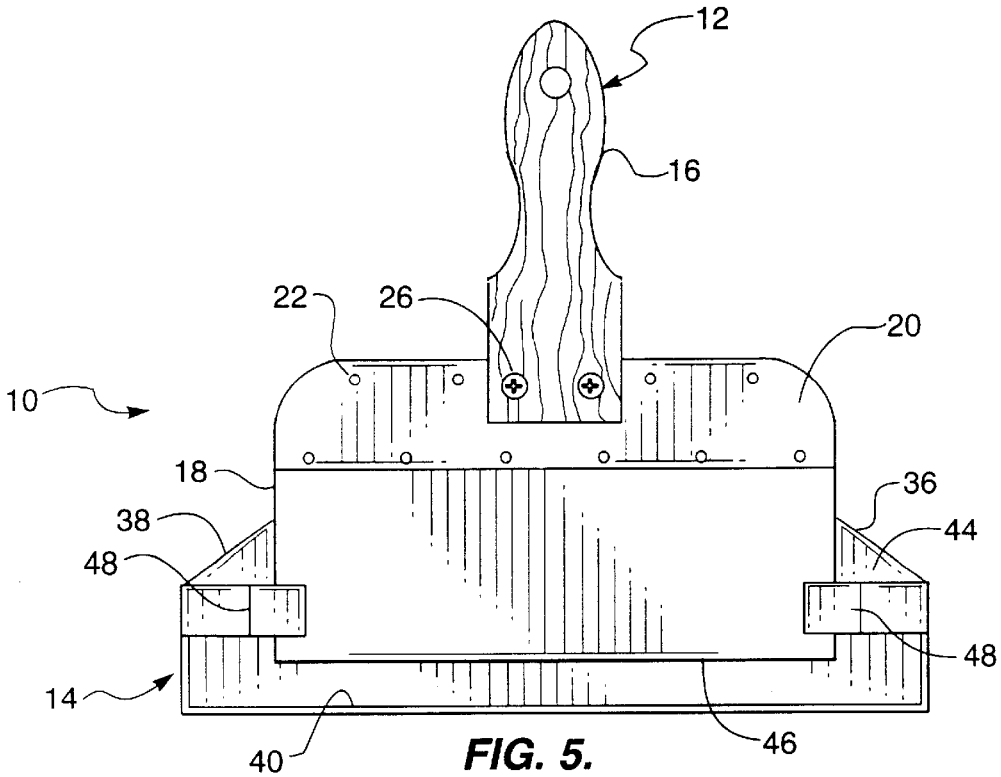
FIG. 5 shows a top view of the embodiment of FIG. 1.

As best seen in FIGS. 3 and 4, a user on a ladder 49 will grasp handle 16 and move device 10 thereby along a ceiling 54 in the direction of an arrow 56. A shoulder 50 is provided at the rear of covered tray 36 which engages a forward edge 52 of handle 16 of ceiling scraper 12 as best seen in FIG. 4. Shoulder 50 and forward edge 52 prevent relative movement between scraper 12 and vacuum accessory 14 when scraper 12 is thus engaged with a ceiling 54. Bits of paint 58 scraped off by scraping edge 46 thereby fall into slot 40 and hence via covered tray 36, vacuum tube 30 and vacuum hose 32 are sucked into vacuum device 34.

Figure 6:
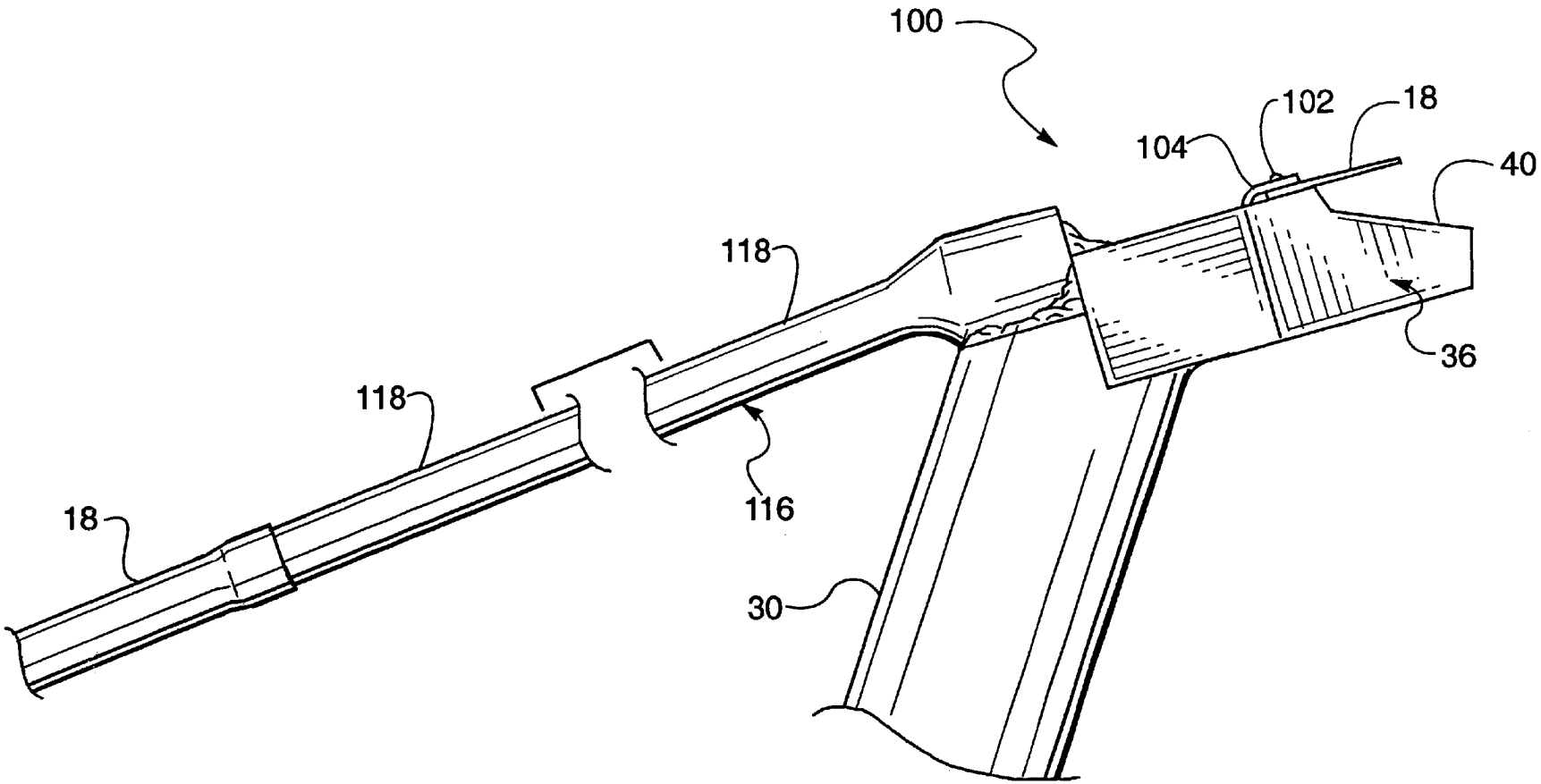
FIG. 6 alternate embodiment of the present invention

An alternate unitary embodiment 100 is best seen in FIG. 6. Device 100 is a unitary construction whereby handle 16 is permanently mounted to and extending rearwardly from covered tray 36. Further, blade 18 is mounted directly to cover 44, preferably by screws 102 and mounting brackets 104 to allow changing of said blade 18 when desired, as, for example, when such blade 18 is too dulled for further use. Lastly, an elongated handle 116 is provided to allow the user to scrape ceiling 54 without needing ladder 49 to reach same. Handle 116 is preferably made of a plurality of handle members 118 which are telescopically received within one another to allow for compact storage of same.

Although only certain embodiments have been illustrated and described, it will be apparent to those skilled in the art that various changes and modifications may be made therein without departing from the spirit of the invention or from the scope of the appended claims.

What is claimed is:

1. A vacuum device for scraping and cleaning a ceiling, the vacuum device comprising:

a ceiling scraper having a handle extending rearwardly from a blade, the blade having a scraping edge adapted to scrape materials from a ceiling at the forward edge thereof;

a vacuum accessory having a rearward facing vacuum tube adapted to engage a vacuum hose from a vacuum device, the vacuum accessory further having a covered tray extending forwardly from the vacuum tube, the covered tray having a vacuum slot opposite said vacuum tube, the vacuum slot, the interior of the covered tray and the vacuum tube being in gaseous communication, the vacuum accessory being adapted to hold the ceiling scraper whereby the scraping edge is positioned directly over the vacuum slot, the handle being elongated, the elongated handle allowing a user to engage a ceiling while standing on a floor and two brackets mounted atop the covered tray which are adapted to engage the edges of the blade thereby preventing lateral movement thereof.

2. The vacuum device of claim 1 wherein the covered tray further comprises enclosed sides extending forwardly and laterally from the vacuum tube to the vacuum slot.

3. The vacuum device of claim 1 wherein the covered tray further includes a shoulder provided at the rear of the covered tray which is adapted to engage a forward edge of the handle, the shoulder and the forward edge thereby preventing relative movement between the scraper and the vacuum accessory when the scraper is operatively engaged.

4. The vacuum device of claim 1 wherein the rearward portion of the blade is captured between two plates secured together by a plurality of rivets, the plates being captured in a slot provided at the forward edge of the handle and secured therein by one or more handle rivets.

5. The vacuum device of claim 1 wherein the blade is about 10 inches wide.

6. The vacuum device of claim 1 wherein the handle is permanently mounted to and extends rearwardly from the covered tray.

7. The vacuum device of claim 1 wherein the handle is comprised of a plurality of handle members telescopically received within each other.

8. A vacuum device for scraping and cleaning a ceiling, the vacuum device comprising:

a ceiling scraper having a handle extending rearwardly from a blade, the blade having a scraping edge adapted to scrape materials from a ceiling at the forward edge thereof; and a vacuum accessory having a rearward facing vacuum tube adapted to engage a vacuum hose from a vacuum device, the vacuum accessory further having a covered tray extending forwardly from the vacuum tube, the covered tray having enclosed sides extending forwardly and laterally from the vacuum tube to a vacuum slot, the vacuum slot being positioned opposite said vacuum tube, the vacuum slot and the interior of the covered tray and the vacuum tube being in gaseous communication, the vacuum accessory being adapted to releasably hold the ceiling scraper whereby the scraping edge is positioned directly over the vacuum slot, the covered tray having two brackets mounted atop the covered tray which are adapted to engage the edges of the blade thereby preventing lateral movement thereof, the covered tray further including a shoulder provided at the rear of the covered tray which is adapted to engage a forward edge of the handle, the shoulder and the forward edge thereby preventing relative movement between the scraper and the vacuum accessory when the scraper is operatively engaged.

9. The vacuum device of claim 8 wherein the handle is permanently mounted to and extends rearwardly from the covered tray.

10. The vacuum device of claim 9 wherein the handle is elongated, the elongated handle allowing a user to engage a ceiling while standing on a floor.

11. The vacuum device of claim 10 wherein the handle is comprised of a plurality of handle members telescopically received within each other.

12. A vacuum accessory comprising:

a rearward facing vacuum tube adapted to engage a vacuum hose from a vacuum device, the vacuum accessory further having a covered tray extending forwardly from the vacuum tube, the covered tray having a vacuum slot opposite said vacuum tube, the vacuum slot, the interior of the covered tray and the vacuum tube being in gaseous communication, the vacuum accessory being adapted to hold a ceiling scraper having a handle extending rearwardly from a blade, the blade having a scraping edge adapted to scrape materials from a ceiling at the forward edge thereof, the vacuum accessory holding the scraping edge directly over the vacuum slot, and two brackets mounted atop the covered tray which are adapted to engage the edges of the blade thereby preventing lateral movement thereof.

13. The vacuum accessory of claim 12 wherein the covered tray further comprises enclosed sides extending forwardly and laterally from the vacuum tube to the vacuum slot.

14. The vacuum accessory of claim 12 wherein the covered tray further includes a shoulder provided at the rear of the covered tray which is adapted to engage a forward edge of the handle, the shoulder and the forward edge thereby preventing relative movement between the scraper and the vacuum accessory when the scraper is operatively engaged.

* * * * *